US012280285B2

(12) United States Patent
Giannico

(10) Patent No.: US 12,280,285 B2
(45) Date of Patent: Apr. 22, 2025

(54) EXERCISE EQUIPMENT

(71) Applicant: LACERTOSUS SRL, Parma (IT)

(72) Inventor: Alessandro Giannico, Bologna (IT)

(73) Assignee: LACERTOSUS SRL, Parma (IT)

( * ) Notice: Subject to any disclaimer, the term of this patent is extended or adjusted under 35 U.S.C. 154(b) by 164 days.

(21) Appl. No.: 18/356,597

(22) Filed: Jul. 21, 2023

(65) Prior Publication Data

US 2024/0108933 A1 Apr. 4, 2024

(30) Foreign Application Priority Data

Sep. 29, 2022 (IT) ..... 102022000020064

(51) Int. Cl.
*A63B 21/06* (2006.01)
*A63B 21/00* (2006.01)
*A63B 21/072* (2006.01)

(52) U.S. Cl.
CPC ..... *A63B 21/0615* (2013.01); *A63B 21/0724* (2013.01); *A63B 21/4035* (2015.10)

(58) Field of Classification Search
CPC ..... A63B 21/0442; A63B 21/0615; A63B 21/0724; A63B 21/0783; A63B 21/4035; A63B 23/1209; A63B 71/0036; A63B 2225/09
See application file for complete search history.

(56) References Cited

U.S. PATENT DOCUMENTS 4,344,619 A 8/1982 Szabo
9,289,646 B2 * 3/2016 Tully ..... A63B 23/03525
9,808,663 B2 * 11/2017 Chen ..... A63B 21/4049
10,994,171 B2 * 5/2021 Nolan ..... A63B 21/159
11,478,674 B1 * 10/2022 Kuka ..... A63B 21/0615
11,590,389 B1 * 2/2023 Nolan ..... A63B 21/4043
2017/0087400 A1 * 3/2017 Chen ..... A63B 21/0628
2017/0087402 A1 * 3/2017 Chen ..... A63B 21/08
2019/0374807 A1 12/2019 Nolan
2020/0114193 A1 4/2020 Tabone

FOREIGN PATENT DOCUMENTS

DE 202016103723 U1 10/2016

OTHER PUBLICATIONS

Search Report and Written Opinion, as issued in connection with Italian Patent Application No. 102022000020064, dated May 17, 2023.

* cited by examiner

*Primary Examiner* — Joshua Lee
(74) *Attorney, Agent, or Firm* — Maschoff Brennan

(57) ABSTRACT

An accessory device for a tool of a landmine type comprising a barbell having a first end at a first sleeve hinged on a surface. The accessory device includes a second sleeve intended to receive a second end of the barbell. The second sleeve has an elongated extension according to a longitudinal axis thereof. The accessory device further includes a first and a second tubular profile originating from the second sleeve and having an extension moving away therefrom, each according to its own direction. The accessory device also includes a first and a second rod respectively originating laterally from said first and second tubular profile. The first and second rod having an extension moving away from the respective tubular profile. The accessory device further includes a fin situated externally on the second sleeve.

17 Claims, 5 Drawing Sheets

PRIOR ART

EXERCISE EQUIPMENT

FIELD

The present invention relates to an accessory device for a tool of the landmine type, a support unit for the accessory device and an equipment for functional training comprising the accessory device and the support unit.

BACKGROUND

A tool for functional training, commercially called "landmine," is known. This tool comprises a plate provided with a bi-directional articulated sleeve, into which one end of a barbell is inserted. Document U.S. Pat. No. 8,974,354 B1 describes such a tool. Ancillary equipment for the tool of the landmine type are also known. They are known as landmine "wishbone" and landmine stand.

The wishbone consists of a sleeve that receives the other end of the barbell and two tubular profiles usually placed on the shoulders during exercise. The accessory tool is then provided with two weight supports (usually "bumper" discs) each mounted on the outer side of the respective tubular profile.

The landmine stand accessory is used as a support for the wishbone under rest condition, for example for loading and unloading weights.

The wishbone accessory features a cylinder-shaped barbell sleeve, while the stand consists of a rest defined by a horizontal roller formed by two mirrored cone trunks that converge towards the center. In other solutions, the roller is replaced by a flat rest similar to a fork.

As illustrated in FIG. 1, the contact area between the sleeve of the wishbone and the roller/fork of the stand is reduced down to one line (which can be schematized as a contact area between two cylinders orthogonal to each other). It follows that the wishbone is not secured to the stand and remains in static balance thanks to its same weight symmetrically distributed over the entire structure.

The balance condition is easily interrupted as soon as the user inserts on (or removes from) one of the two supports a weight (even minimal), creating an imbalance of the system.

With reference to the illustrations of FIGS. 2*a* and 2*b*, the disc by gravity will be pulled downwards generating a twisting moment on the wishbone having as arm the distance between the weight and the resting point wishbone-stand (described above). It therefore follows that the entire wishbone accessory will be inclined to overturn, causing the weight to fall to the ground. Both events are an element of risk and danger for the safety of the person and their surroundings. Moreover, if we consider that most of the sleeves of the barbells, on which the wishbone is secured, are able to rotate thanks to a system of bushings or bearings around their axis, the overturning action is further favored and accelerated.

As another example, document DE 20 2016 103723 U1 discloses an accessory device for a tool of the landmine type.

SUMMARY

An accessory device for a tool of a landmine type comprising a barbell having a first end at a first sleeve hinged on a surface. The accessory device includes a second sleeve intended to receive a second end of the barbell. The second sleeve has an elongated extension according to a longitudinal axis thereof. The accessory device further includes a first and a second tubular profile originating from the second sleeve and having an extension moving away therefrom, each according to its own direction. The accessory device also includes a first and a second rod respectively originating laterally from said first and second tubular profile. The first and second rod having an extension moving away from the respective tubular profile. The accessory device further includes a fin situated externally on the second sleeve.

BRIEF DESCRIPTION OF THE DRAWINGS

Further features and advantages of the present disclosure will become more apparent from the approximate and thus non-limiting description of some embodiments of an accessory device for a tool of the landmine type, a support unit for the accessory device and an equipment for functional training, as illustrated in the accompanying drawings in which.

DESCRIPTION OF EMBODIMENTS

Figure 1:
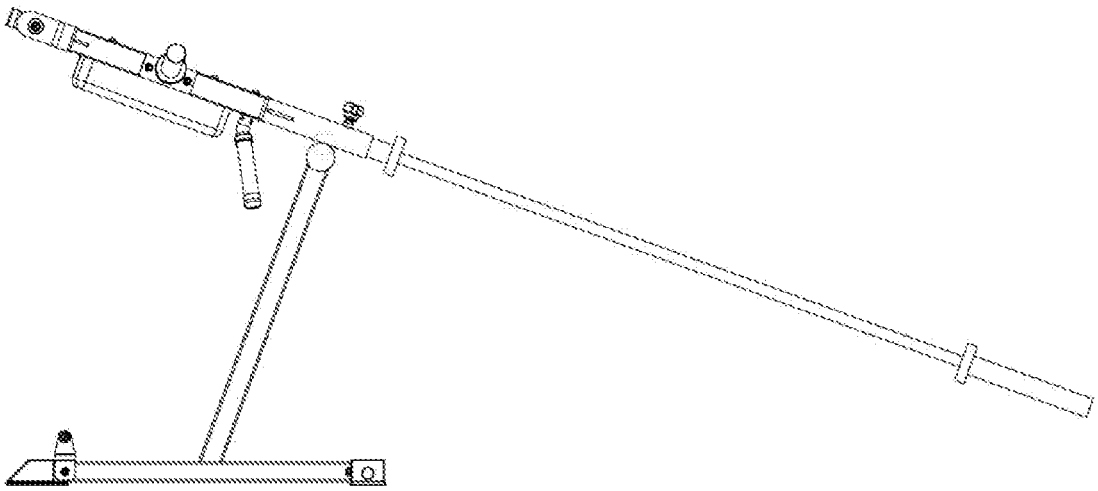
FIGS. 1, 2*a*, and 2*b* illustrate landmine type equipment from the prior art.
Figure 2A:
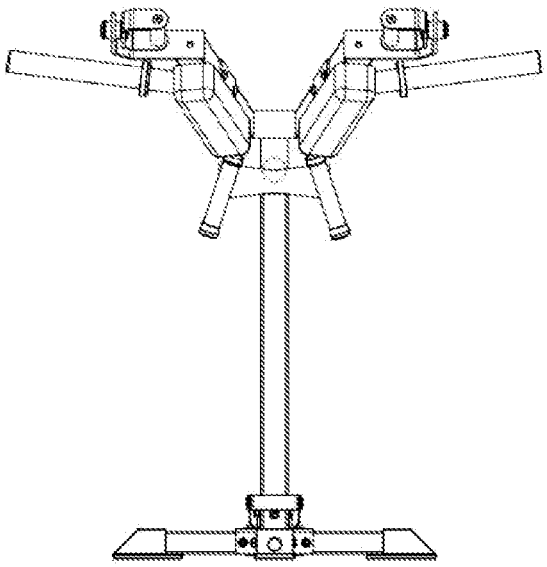
PRIOR ART FIG. 2a
Figure 2B:
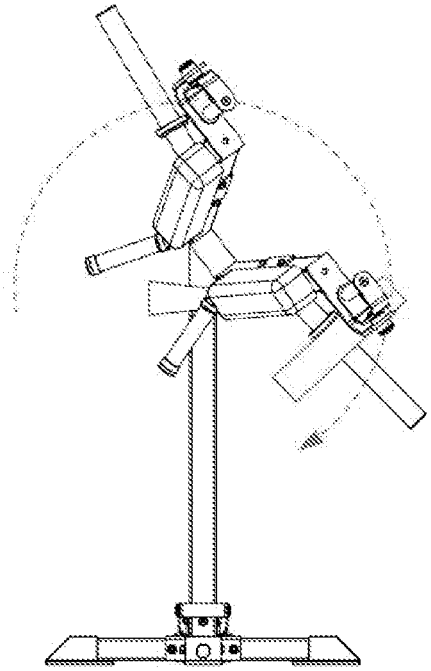
Figure 3:
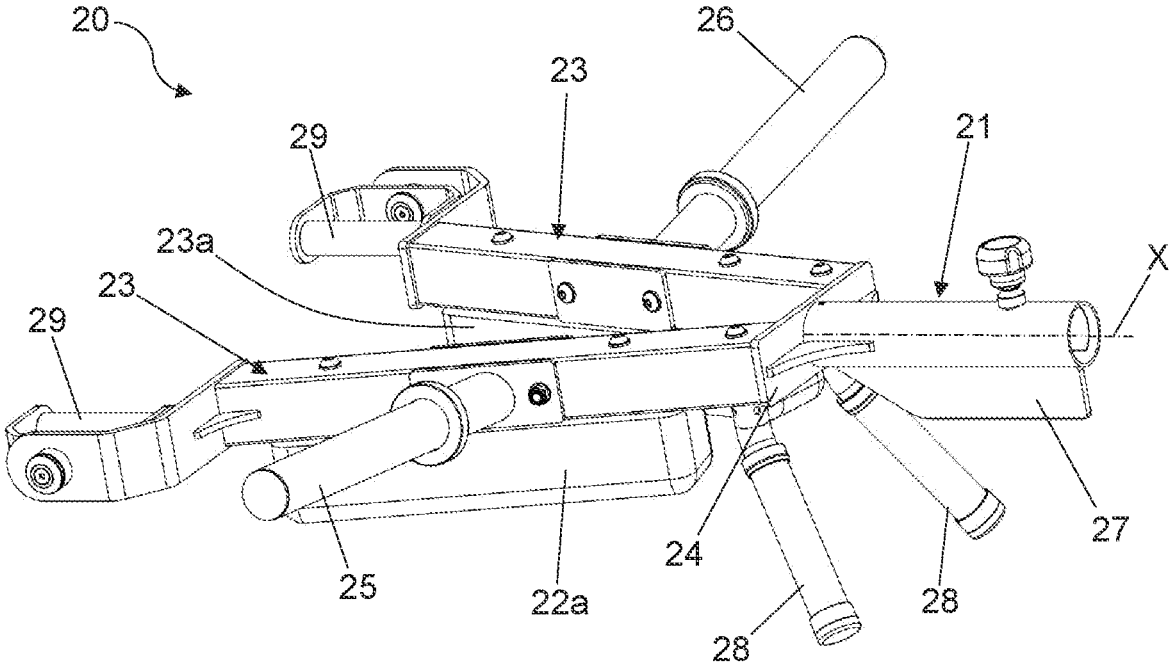
FIG. 3 illustrates an accessory device for a tool of the landmine type, subject-matter of the present disclosure, in perspective view.
Figure 4:
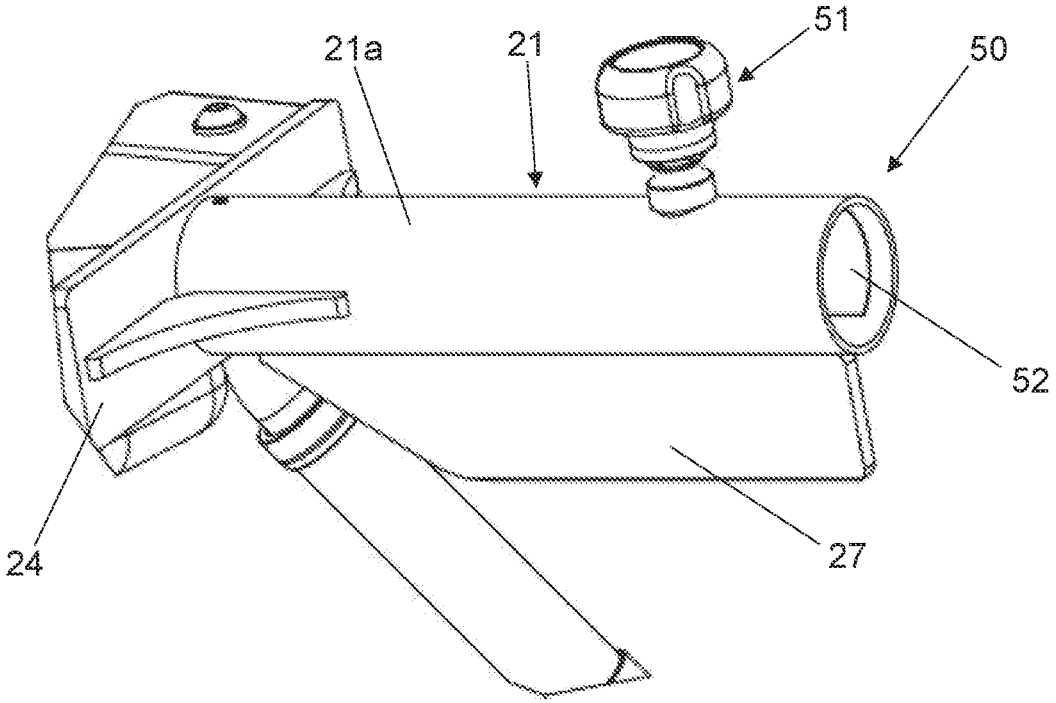
FIG. 4 illustrates a detail (sleeve with fin) of the accessory device of FIG. 3.
Figure 5:
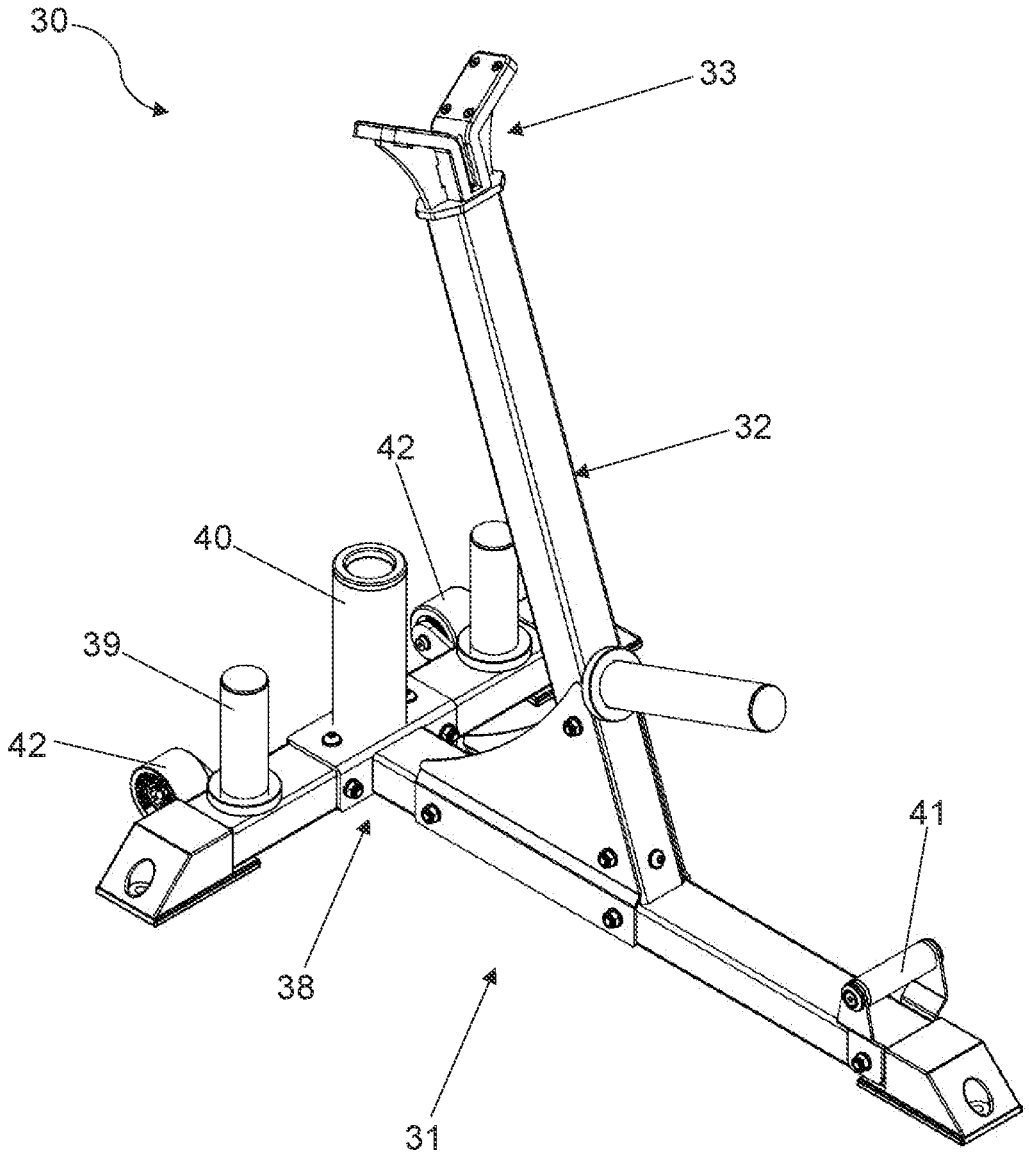
FIG. 5 illustrates a support unit for the accessory device of FIG. 3, subject-matter of the present disclosure, in perspective view.
Figure 6:
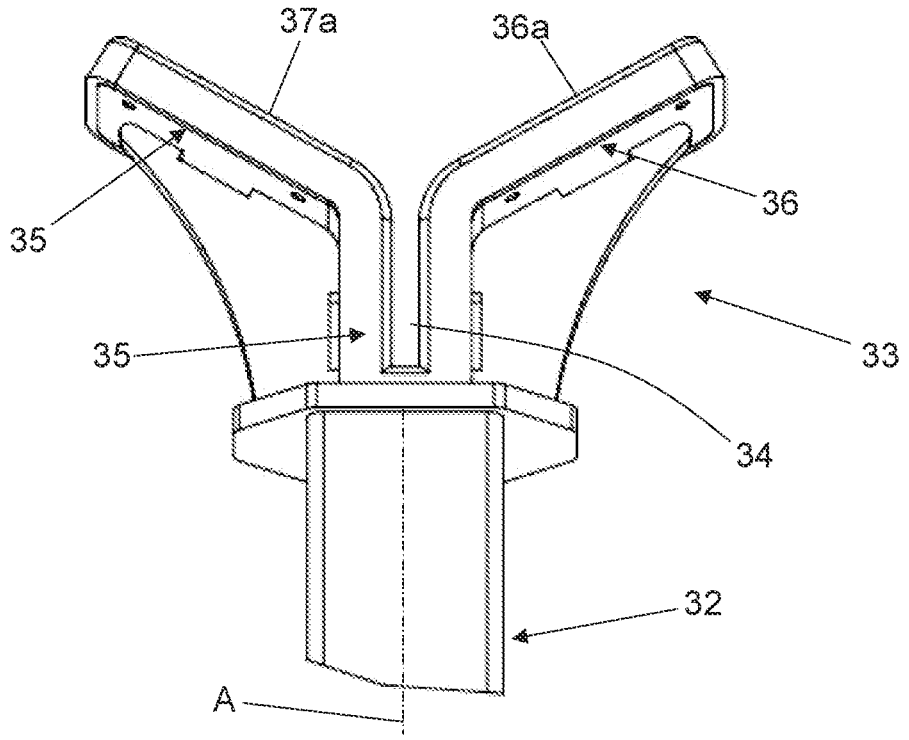
FIG. 6 illustrates a detail (support head with recess) of the support unit of FIG. 5.
Figure 7:
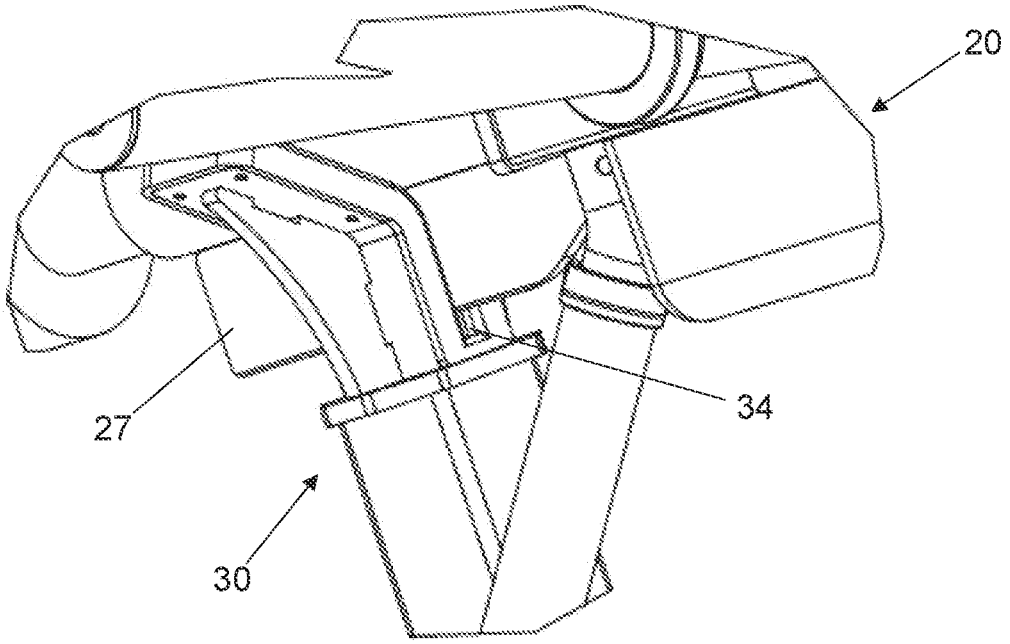
FIG. 7 illustrates a detail (fin of the sleeve inserted into the recess of the support head) of a mounted condition of the accessory device of FIG. 3 on the support unit of FIG. 5.

The present disclosure falls within the field of overload training equipment. Currently the safest method to load training equipment, such as a wishbone equipment, is to load it symmetrically on the ground and then lift it and place it on the stand.

However, this involves another problem. In fact, this equipment is also used to train the legs with exercises that often include high loads compared to those bearable for a joint such as the shoulder. This implies an increase in the risk of injury to the user.

Another solution is to have the tool loaded simultaneously by two people, but this necessarily implies the presence of a second individual, which is difficult especially in a home training context.

In this context, the technical task underpinning the present disclosure is to propose an accessory device for a tool of the landmine type, a support unit for the accessory device and an equipment for functional training, which overcome the aforementioned drawbacks.

In particular, an object of the present disclosure is to propose an accessory device for a tool of the landmine type, a support unit for the accessory device and an equipment for functional training, which ensure high safety for the user.

Another object of the present disclosure is to make available an accessory device for a tool of the landmine type, a support unit for the accessory device and an equipment for functional training, wherein the risk of overturning of the accessory device when resting on the support unit, during weight loading and unloading operations, is reduced.

The specified technical task and the specified objects are substantially achieved by an accessory device for a tool of the landmine type comprising a barbell having a first end at a first sleeve hinged on a surface, for example a floor or terrain, said accessory device comprising:

- a second sleeve intended to receive a second end of the barbell, said second sleeve having an elongated extension according to a longitudinal axis thereof;
- a first and a second tubular profile originating from the second sleeve and having an extension moving away therefrom, each according to its own direction;
- a first and a second rod respectively originating laterally from the first and the second tubular profile, said first and second rod having extension moving away from the respective tubular profile;
- a fin situated externally on the second sleeve.

In accordance with one embodiment, the fin has an elongated extension according to a direction substantially parallel to the longitudinal axis of the second sleeve.

In accordance with an embodiment, the second sleeve comprises a substantially cylindrical and elongated outer surface according to the longitudinal axis, said fin having an elongated extension along the outer surface.

In accordance with one embodiment, the fin has a substantially rectangular shape. The stated technical task and the specified objects are substantially achieved by a support unit, comprising:

- a base configured to rest on a surface;
- a pole mounted on the base and having an elongated extension according to a first direction moving away therefrom;
- a support head situated at one end of the pole, said support head comprising a recess shaped to receive the fin of an accessory device as described.

In accordance with an embodiment, the recess extends in depth according to a direction substantially parallel to the first direction of extension of the pole.

In accordance with an embodiment, the recess has a parallelepiped shape.

In accordance with one embodiment, the support head comprises:

- a central first portion having said recess;
- a second and a third portion originating from said first portion with an extension moving away from said first portion according to two directions diverging from one another, said second and third portion featuring respectively a first and a second support surface for the second sleeve.

In accordance with one embodiment, the first surface, the second surface and the recess define a substantially Y shape.

The stated technical task and the specified objects are substantially achieved by a tool for functional training, comprising:

- a tool of the landmine type comprising:
  - a base to be fixed to a surface, for example a floor or terrain;
  - a first sleeve hinged on said base;
  - a barbell having a first end mounted on the first sleeve;
- an accessory device as described, the barbell of said tool of the landmine type having a second end mounted on the second sleeve of the accessory device; a support unit as described.

The equipment is configurable in a first work condition, in which the second sleeve is removed and moved away from the support head of the support unit, and a second rest condition, in which the second sleeve rests on the support head of the support unit, in said second rest condition the fin of the accessory device being inserted into the recess of the support unit.

With reference to the figures, the present disclosure refers to the context of functional training which makes use of a tool of the landmine type 10. This wording refers to a tool of known type: a brief explanation of the minimum components by which this tool is formed is provided below, however any known configuration may be used. As already indicated above, reference may be made to document U.S. Pat. No. 8,974,354B1 as prior art on the tool of the landmine type 10.

Figure 8:
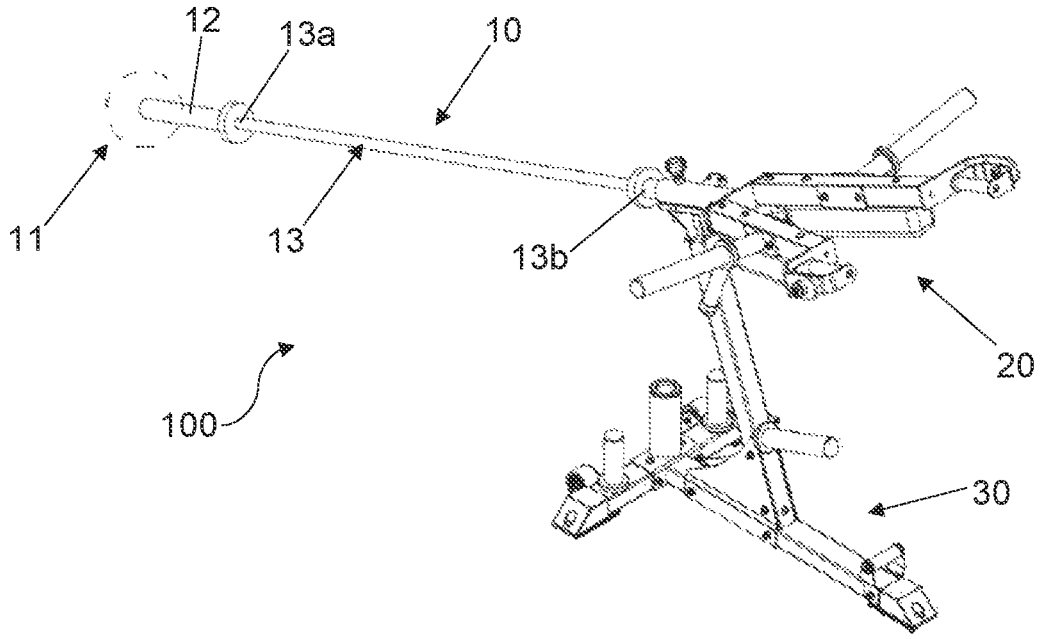
FIG. 8 illustrates an equipment for functional training, comprising the accessory device of FIG. 3 and the support unit of FIG. 5, in perspective view.

The tool of the landmine type 10 comprises a base 11 to be fixed to a surface, for example a floor or terrain. For example, the base 11 is a plate. In FIG. 8, the base 11 is illustrated schematically.

The tool of the landmine type 10 comprises a first sleeve 12 hinged on the base 11. The first sleeve 12 is a perforated cylinder.

In some embodiments, the first sleeve 12 is hinged such that it can rotate with respect to two mutually orthogonal hinging axes. In some embodiments, the first sleeve 12 is mounted in a bi-directional articulated manner.

The tool of the landmine type 10 comprises a barbell 13 having a first end 13*a* mounted in the first sleeve 12.

With reference to the figures, the number 20 indicates an accessory device, suitable for use on the tool of the landmine type 10, and the number 30 indicates a support unit for the accessory device, both subject-matter of the present disclosure.

The accessory device 20 comprises a second sleeve 21 intended to receive a second end 13*b* of the barbell 13. The second sleeve 21 has an elongated extension according to a longitudinal axis X thereof. In some embodiments, the second sleeve 21 is a perforated cylinder.

The accessory device 20 comprises a first tubular profile 22 and a second tubular profile 23. The first and second tubular profiles 22, 23 originate from the second sleeve 21 and each have an extension along an own direction of movement away therefrom, respectively.

In some embodiments, a plate 24 is interposed between the second sleeve 21 and the first and second tubular profiles 22, 23.

In the embodiment illustrated in the figures, the first and second tubular profile 22, 23 have an extension diverging from one another moving away from the second sleeve 21. The divergent extension makes it easy to adapt the tool to a user's shoulder width.

In an alternative embodiment, the first and second tubular profile 22, 23 are substantially parallel to each other. In such a case, a third tubular profile mounted at one end of the second sleeve may be present. The third tubular profile is orthogonal to the first two. From the third tubular profile, the first and second tubular profile 22, 23 extend parallel to each other, thus defining a square U-shape.

In the preferred embodiment illustrated in the figures, the tubular profile 22, 23 are square in section.

In some embodiments, the tubular profiles 22, 23 each comprise a padded portion 22*a*, 23*a*.

The accessory device 20 comprises a first rod 25 and a second rod 26. The first rod 25 originates laterally from the first tubular profile 22. The second rod 26 originates laterally from the second tubular profile 23. In particular, they originate respectively from outer sides of the first and second tubular profiles 22, 23. The first rod 25 and the second rod 26 extend moving away from the respective tubular profile 22, 23.

Such rods 25, 26 are intended to receive weights, usually in the form of perforated discs or "bumpers".

In some embodiments, the first and second rods 25, 26 are inclined upwards in their extension moving away from the tubular profiles 22, 23. By the expression "upwards" is meant on the opposite side of the tubular profiles 22, 23 with respect to the resting area intended for the shoulders. For example, the first and second rods 25, 26 have an 8° inclination with respect to a horizontal.

Originally, the accessory device 20 comprises a fin 27 mounted externally on the second sleeve 21.

In some embodiments, the fin 27 has an elongated extension according to a direction substantially parallel to the longitudinal axis X of the second sleeve 21.

In some embodiments, the second sleeve 21 comprises a substantially cylindrical and elongated outer surface 21*a* according to the longitudinal axis X. The fin 27 has an extension along the outer surface 21*a*.

In other words, the fin 27 has a radial extension moving away from the outer surface 21*a*.

In some embodiments, the fin 27 has a substantially rectangular shape.

Typically, to use such an accessory device 20, the user places himself below the tubular profiles 22, 23 or the pads 22*a*, 23*a* when present, squatting down. Since the accessory device 20 under use conditions is mounted on one end of the barbell 13, in turn hinged on the opposite end to a fixed base, it is necessary to resort to a support for the accessory device 20 when the user is not performing the use.

In this regard, a support unit 30 is used. The support unit 30 comprises a support base 31 configured to rest on a surface, for example a floor or terrain.

The support unit 30 comprises a pole 32 mounted on the support base 31. The pole 32 has an elongated extension according to a first direction A moving away therefrom. In some embodiments, the pole 32 is inclined with respect to a vertical.

The support unit 30 comprises a support head 33 situated at one end of the pole 32. The accessory device 20 (or even the barbell 13 alone when the accessory device 20 is not used) is placed on the support head 33 under unused conditions. In particular, the second sleeve 21 of the accessory device 20 is placed on the support head 33.

Originally, the support head 33 comprises a recess 34 shaped to receive the fin 27. In this way, when the accessory device 20 is placed to rest on the support head 33, the fin 27 fits into the recess 34 and prevents the accessory device 20 from overturning when a weight is loaded (or unloaded) from one of the two support rods 25, 26, generating an imbalance in the loads.

Figure 9:
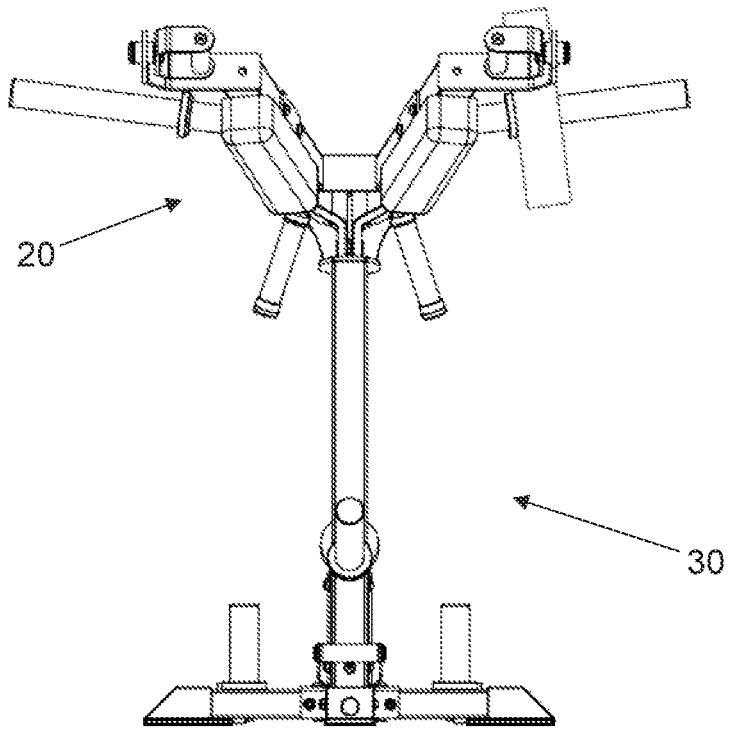
FIG. 9 illustrates a rear view of the equipment of FIG. 8, on which a bumper disc is mounted on one side of the accessory device.

Through coupling, the rotation on itself of the second sleeve 21, on which the fin 27 is mounted, is in fact prevented. In other words, the fin 27 and the recess 34 are mutually shaped to define, when the fin 27 is inserted into the recess 34, anti-rotation mechanism of the second sleeve 21 with respect to its longitudinal axis X. As visible in FIG. 9, the weight loaded on one of the two rods 25, 26 does not cause the accessory device 20 to overturn thanks to the fin 27 mounted in the recess 34.

In some embodiments, the recess 34 extends in depth according to a direction substantially parallel to the first extension direction A of the pole 32.

In some embodiments, the recess 34 has a parallelepiped shape.

In the preferred embodiment, the support head 33 comprises a first central portion 35 having the recess 34. The support head 33 comprises a second portion 36 and a third portion 37 originating from the first portion 35 with an extension moving away therefrom according to two directions diverging from one another.

The second portion 36 and the third portion 37 feature respectively a first surface 36*a* and a second support surface 37*a* for the second sleeve 21. In other words, the second sleeve 21 rests on the two support surfaces 36*a*, 37*a*, with the fin 27 inserted into the recess 34.

In particular, the first surface 36*a* and second surface 37*a* define a V-shape.

In some embodiments, the support head 33 defined by the three portions 35, 36, 37 is Y-shaped. In detail, the first surface 36*a*, the second surface 37*a* and the recess 34 define a substantially Y-shape.

In some embodiments, the second portion 36 and the third portion 37 are coated by a covering of polymeric material, for example rubber. In fact, the tools are generally made of metal material and such covering avoids contact between the metal parts of the support unit 30 with those of the accessory device 20. In this way the wear of the components is reduced, with consequent lengthening of life. In addition, the noise of the tools during use is decreased.

In some embodiments, the accessory device 20 is provided with one or more pairs of handles. Two pairs of handles are illustrated for example in the figures. A first pair of handles 28 is located at a portion of the first and second tubular profile 22, 23 proximate the second sleeve 21. This first pair of handles 28 extends moving away from the tubular profiles 22, 23 on the side of the second sleeve 21.

A second pair of handles 29 is arranged at the end of the tubular profiles 22, 23 on the opposite side with respect to the second sleeve 21. These handles 29 are rotatable about their axis in such a way as to guarantee the user a grip that allows him/her to perform lifting exercises such as the so-called "clean and jerk".

The user places himself below the accessory device 20, with his/her shoulders below the tubular profiles 22, 23, squatting down. The user grabs the first pair of handles 28 or the second pair of handles 29, depending on the type of exercise he/she intends to perform. In the first case, exercises like squats and lunges can be performed. In this regard, the user will free the accessory device 20 from the interlock at the support head 33, to perform the exercises away from the support unit 30.

In the second case, all push exercises can be performed, for example shoulder press, possibly also remaining within the area delimited by the support unit 30 (depending on the range of motion it is wished to perform).

In some embodiments, the accessory device 20 is provided with locking mechanism 50 for the barbell 13. The locking mechanism 50 comprise a knob 51 provided with a screw. The knob 51 is arranged above the second sleeve 21, with the screw engaged transversely therein. The knob 51 comprises a C-section sheet metal 52 located inside the second sleeve 21. In detail, the knob 51, provided with a screw, if screwed, presses on the sheet metal 52 which compresses the barbell 13 by locking it in the second sleeve 21. The presence of the sheet metal allows the compression force to be better distributed on the surface of the sleeve, preventing it from being damaged.

In the illustrated embodiment, the support base 31 of the support unit 30 comprises a T-tubular profile group 38.

Various accessories are mounted on the support base 31, such as for example support elements 39 in the disassembled condition of the accessory device 20, a barbell holder 40, a handle 41 for the movement and wheels 42.

The present disclosure also relates to an equipment 100 for functional training.

The equipment 100 comprises a tool of the landmine type 10, an accessory device 20 and a support unit 30 as previously described. In particular, the barbell 13 has a second end 13*b* inserted into the second sleeve 21 of the accessory device 20.

The equipment is configurable in a first work condition, in which the second sleeve 21 is removed and moved away from the support head 33 of the support unit 30, and a second rest condition, in which the second sleeve 21 rests on the support head 33. In the second rest condition, the fin 27 of the accessory device 20 is inserted into the recess 34 of the support unit 30.

The characteristics of the accessory device for a tool of the landmine type, of the support unit for the accessory device and of the equipment for functional training according to the present disclosure are clear from the description, as are the advantages thereof.

In particular, the interaction between the fin of the accessory device and the recess of the support unit allows a solid mechanical constraint that limits the risk of overturning. In this way, even if a single disc has been loaded on only one side of the accessory device, since the rotation start, the surface of the fin (orthogonal to the second sleeve) immediately comes into contact with the internal surface of the recess, keeping the tool in position.

In the event that in the presence of high weights (for example, loading a 25 kg bumper, which corresponds to the maximum size in the world of weighing) there is a small displacement, the inclination of the rods prevents the bumper disc from sliding out of the sleeve.

In addition, if the fin and the recess are elongated, the contact area between the two components is increased, thus exerting a force that opposes the major overturning.

Furthermore, the conformation of the support head with the first, second and third portion, in particular the V-entry of the Y-head favours the insertion of the fin inside the recess. At the same time, it provides an extended contact area with the second sleeve of the accessory device.

In accordance with common practice, the various features illustrated in the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited herein are intended for pedagogical objects to aid the reader in understanding the and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

The invention claimed is:

1. An accessory device for a tool of a landmine type comprising a barbell having a first end at a first sleeve hinged on a surface, the accessory device comprising:

a second sleeve intended to receive a second end of the barbell, said second sleeve having an elongated extension according to a longitudinal axis thereof;

a first and a second tubular profile originating from the second sleeve and having an extension moving away therefrom, each according to its own direction;

a first and a second rod respectively originating laterally from said first and second tubular profile, said first and second rod having an extension moving away from the respective tubular profile; and a fin situated externally on the second sleeve.

2. The accessory device according to claim 1, wherein said fin has an elongated extension according to a direction substantially parallel to the longitudinal axis of the second sleeve.

3. The accessory device according to claim 1, wherein said second sleeve comprises a substantially cylindrical and elongated outer surface according to said longitudinal axis, said fin having an elongated extension along the outer surface.

4. The accessory device according to claim 1, wherein the fin has a substantially rectangular shape.

5. A support unit, comprising:

a base configured to rest on a surface;

a pole mounted on the base and having an elongated extension according to a first direction moving away from the base;

a support head situated at one end of the pole, wherein said support head comprises a recess shaped to receive a fin of an accessory device, the accessory device including:

a sleeve intended to receive an end of a barbell, said sleeve having an elongated extension according to a longitudinal axis thereof;

a first and a second tubular profile originating from the sleeve and having an extension moving away therefrom, each according to its own direction; and a first and a second rod respectively originating laterally from said first and second tubular profile, said first and second rod having an extension moving away from the respective tubular profile, wherein the fin is situated externally on the sleeve.

6. The support unit according to claim 5, wherein said recess extends in depth according to a direction substantially parallel to the first direction of extension of the pole.

7. The support unit according to claim 5, wherein said recess has a parallelepiped shape.

8. The support unit according to claim 5, wherein said support head comprises:

a central first portion having said recess; and a second and a third portion originating from said first portion with an extension moving away from said first portion according to two directions diverging from one another, said second and third portion featuring respectively a first and a second support surface for the sleeve.

9. The support unit according to claim 8, wherein the first surface, the second surface and the recess define a substantially Y shape.

10. Equipment for functional training, the equipment comprising:

a tool of a landmine type comprising:

a base to be fixed to a surface;

a first sleeve hinged on said base;

a barbell having a first end mounted on the first sleeve;

an accessory device comprising:

a second sleeve intended to receive a second end of the barbell, said second sleeve having an elongated extension according to a longitudinal axis thereof;

a first and a second tubular profile originating from the second sleeve and having an extension moving away therefrom, each according to its own direction;

a first and a second rod respectively originating laterally from said first and second tubular profile, said first and second rod having an extension moving away from the respective tubular profile; and a fin situated externally on the second sleeve; and a support unit comprising:

a support base configured to rest on the surface;

a pole mounted on the base and having an elongated extension according to a first direction moving away from the base; and a support head situated at one end of the pole, wherein said support head comprises a recess shaped to receive the fin of the accessory device, said equipment being configurable in a first work condition, in which the second sleeve is removed and moved away from the support head of the support unit, and a second rest condition, in which the second sleeve rests on the support head of the support unit, in said second rest condition the fin of the accessory device being inserted into the recess of the support unit.

11. The equipment according to claim 10, wherein said fin has an elongated extension according to a direction substantially parallel to the longitudinal axis of the second sleeve.

12. The equipment according to claim 10, wherein said second sleeve comprises a substantially cylindrical and elongated outer surface according to said longitudinal axis, said fin having an elongated extension along the outer surface.

13. The equipment according to claim 10, wherein the fin has a substantially rectangular shape.

14. The equipment according to claim 10, wherein said recess extends in depth according to a direction substantially parallel to the first direction of extension of the pole.

15. The equipment according to claim 10, wherein said recess has a parallelepiped shape.

16. The equipment according to claim 10, wherein said support head comprises:

a central first portion having said recess; and a second and a third portion originating from said first portion with an extension moving away from said first portion according to two directions diverging from one another, said second and third portion featuring respectively a first and a second support surface for the second sleeve.

17. The equipment according to claim 16, wherein the first surface, the second surface and the recess define a substantially Y shape.

* * * * *